US005256126A

United States Patent [19]

Grotstein

[11] Patent Number: 5,256,126

[45] Date of Patent: Oct. 26, 1993

[54] ABDOMINAL AND BACK EXERCISING DEVICE

[75] Inventor: Todd Grotstein, Pittsburgh, Pa.

[73] Assignee: Grote Sport Inc., Pittsburgh, Pa.

[21] Appl. No.: 831,796

[22] Filed: Feb. 5, 1992

[51] Int. Cl.[5] ..... A63B 26/00

[52] U.S. Cl. ..... 482/142; 482/121; 482/133

[58] Field of Search ..... 482/142, 92, 100, 111, 482/121, 122, 123, 129, 133, 135, 136, 139, 140, 130

[56] References Cited

U.S. PATENT DOCUMENTS

| | | | |
|---|---|---|---|
| D. 280,224 | 8/1985 | Wilson . | |
| 1,734,238 | 11/1929 | Sweeney . | |
| 2,938,572 | 5/1960 | Solloway et al. | 482/142 |
| 3,976,058 | 8/1976 | Tidewell | 482/130 |
| 4,204,676 | 5/1980 | Givens . | |
| 4,511,137 | 4/1985 | Jones | 482/142 |
| 4,583,731 | 4/1986 | Crivello et al. . | |
| 4,627,619 | 12/1986 | Rockwell et al. . | |
| 4,635,934 | 1/1987 | Roethke | 482/104 |
| 4,809,976 | 3/1989 | Berger . | |
| 4,813,667 | 3/1989 | Watterson | 482/73 |
| 4,819,936 | 4/1989 | Muller . | |
| 4,861,025 | 8/1989 | Rockwell | 482/142 |
| 4,902,008 | 2/1990 | Jones . | |
| 4,902,009 | 2/1990 | Jones . | |
| 4,949,960 | 8/1990 | Harlan . | |

FOREIGN PATENT DOCUMENTS

| | | |
|---|---|---|
| 1445504 | 6/1966 | France . |

*Primary Examiner*—Richard J. Apley
*Assistant Examiner*—Jerome Donnelly
*Attorney, Agent, or Firm*—Buchanan Ingersoll; Michael L. Dever

[57] ABSTRACT

An apparatus for exercising the abdominal and lower back muscles of a human exerciser is provided in which a frame supports a seat and a pivotable barrier. The exerciser adjusts the seat and the pivotable barrier along the length of the frame. A resilient member connects the pivotable barrier to the frame and opposes rotation of the barrier in a direction away from the seat. By opposing this rotation, the resilient member permits the user of the apparatus to exercise his abdominal muscles when he pushes against the barrier when he faces the barrier and to exercise his lower back muscles when he pushes against the barrier when he faces away from the barrier.

6 Claims, 4 Drawing Sheets

ABDOMINAL AND BACK EXERCISING DEVICE

BACKGROUND OF THE INVENTION

This invention relates to the field of exercising apparatus and more particularly to the field of exercising apparatus specifically designed for exercising abdominal and back muscles.

DESCRIPTION OF THE PRIOR ART

The prior art describes many types of exercise apparatus. Some of these apparatus, such as Berger, U.S. Pat. No. 4,809,976, and Muller, U.S. Pat. No. 4,819,936, are designed to exercise or stretch various muscle groups throughout the body. Such multi-purpose exercisers are usually capable of being used in a number of different manners to exercise the various muscle groups.

Other exercise apparatus are designed to exercise specific muscles, muscle groups, or areas of the body. Examples of such specific purpose exercise apparatus are Givens, U.S. Pat. No. 4,204,676 for a back exerciser; Crivello et al., U.S. Pat. No. 4,583,731 for a spinal exercising apparatus; and Rockwell et al., U.S. Pat. No. 4,627,619, for an abdominal and back weight type exercising device.

Traditionally, because of the bulky size of the exercise apparatus and the high cost associated therewith, such equipment is usually found only in gyms or fitness centers. However, recent trends favor the utilization of home exercise units. Such home units generally must be compact, relatively inexpensive, and capable of being used without constant supervision. Such home units must also be adaptable for use by exercisers of wide-ranging physical condition and at wide-ranging physical levels of exercise.

Two of the more difficult sets of muscles to exercise are the abdominal and lower back muscle sets. These muscle sets are antagonistic in that they oppose and limit the movement of one another. Proper strength and muscle tone of each muscle set is important for appropriate posture and physical health. Despite the importance of the abdominal/lower back muscle set, the muscles of the lower back tend to be forgotten in most exercise routines. Consequently, there is a need for a compact, inexpensive abdominal and lower back exercise apparatus capable of being used at home with little or no supervision.

SUMMARY OF THE INVENTION

An apparatus is provided for specifically exercising the abdominal and lower back muscles of a human exerciser. The apparatus includes a frame having a horizontal member supported on each end thereof by a pair of collapsible legs. The horizontal member is provided with a plurality of spaced apart openings therethrough. These spaced apart openings are arranged in a line along the axial length of the horizontal member.

An adjustable seat member is supported on the frame by the horizontal member. The seat member is provided with means to adjust its position along the length of the horizontal member. A securing member such as a pin can be inserted through the openings in the horizontal member and through the seat to secure the seat to a specific location on the horizontal member. In such a manner, the position of the seat along the frame can be adjusted.

A pivotable upright member is also mounted on the frame. The pivotable member is adjustable along the length of the horizontal member in the same manner as the seat member. The pivotable member is formed from two side bars joined at the top by a padded cross-piece. Resilient connecting means are secured to the upright member at a position below the horizontal member and the frame. The resilient means is arranged so that it opposes movement of the pivotable member in a direction away from the seat member.

In operation, an exerciser sits on the seat member either facing or opposing the pivotable member. The exerciser pushes against the padded cross-piece provided on the pivotable member with his front or his back thereby exercising the abdominal or lower back muscles, respectively. Preferably, a leg securing means is provided on one end of the frame. This leg securing means includes an upright structure attached to one of the legs of the frame and a padded cross member to provide an upper restraint against lifting of the legs when exercising the lower back muscles.

DESCRIPTION OF THE PREFERRED EMBODIMENT

Figure 1:
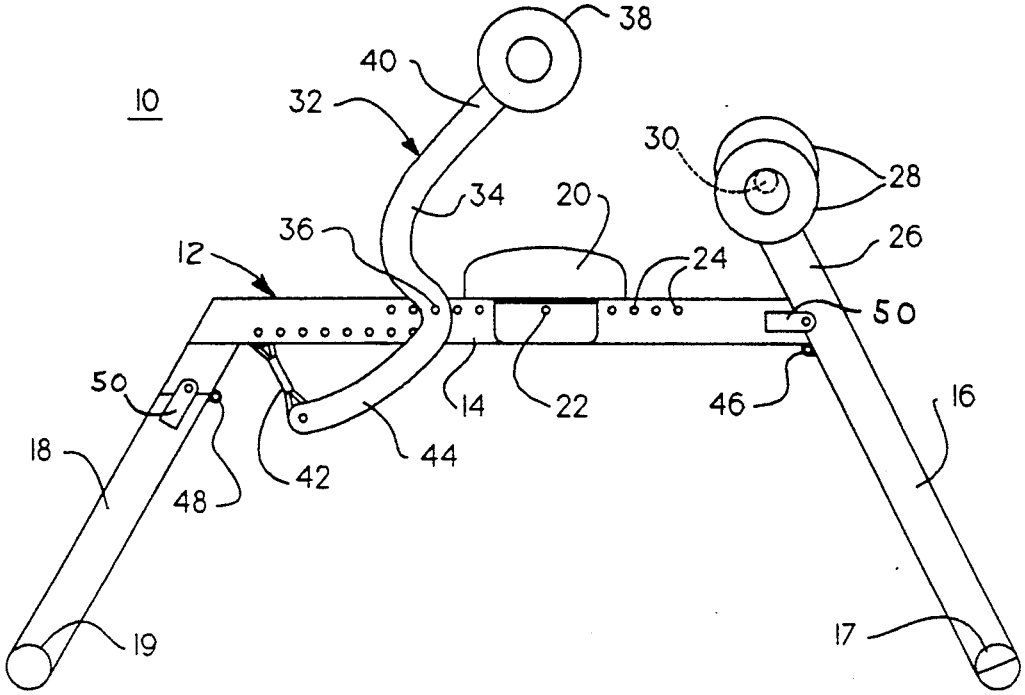
FIG. 1 is a side elevational view in section of a presently preferred embodiment of the abdominal and back muscle exercising device of the present invention.
Figure 2:
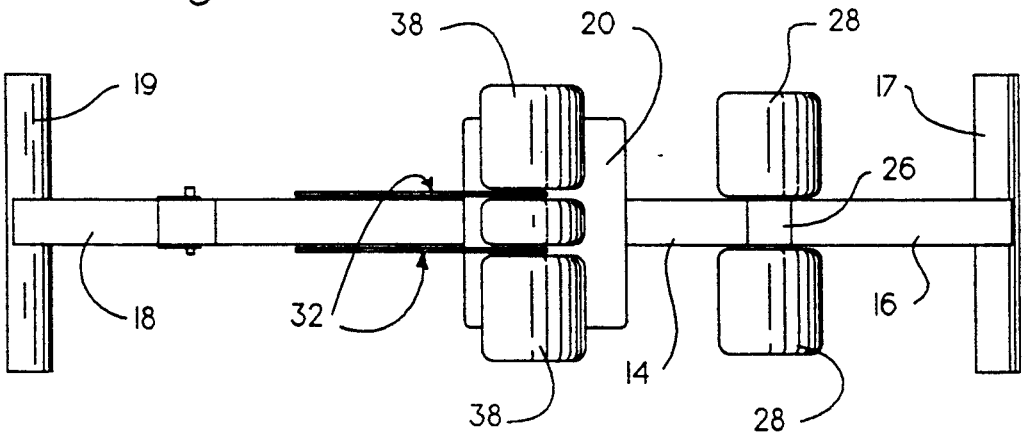
FIG. 2 is a top plan view of the abdominal and back muscle exercising device of FIG. 1.
Figure 3:
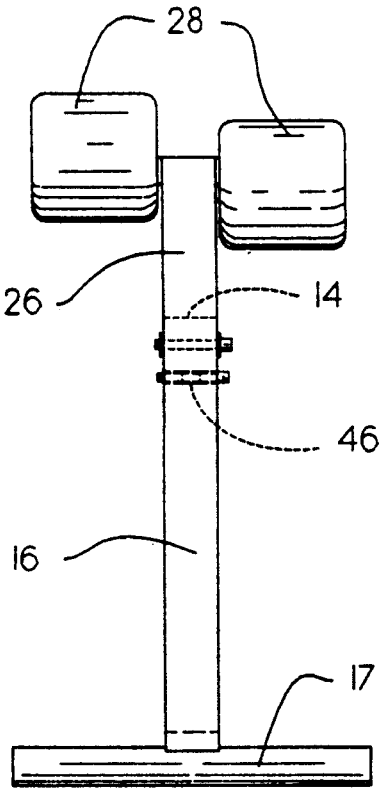
FIG. 3 is a front end elevational view of the abdominal and back muscle exercising device of FIG. 1.

FIGS. 1–4 show exercise apparatus 10 consisting essentially of a frame 12 on which an exerciser sits to exercise his abdominal or lower back muscles. The exerciser can lean back or forward against a barrier which swings away from the exerciser against the pull of an elastic or other spring mechanism.

Frame 12 includes a horizontal member 14 and legs 16 and 18 provided at each end of horizontal member 14. Cross-pieces 17 and 19 provided at the base of legs 16 and 18, respectively, provide stability to frame 12. Seat 20 is fastened to horizontal member 14. The position of seat 20 is adjustable along the length of member 14 by means of a pin which passes through an opening 22 provided in the seat and any one of a plurality of openings 24 provided on the horizontal member 14. Alternatively, other locking means may be utilized.

Leg 16 of frame 12, hereinafter designated as the front leg, is provided with an upper extension 26 which supports a pair of padded cross members 28. Padded cross members 28 are each connected to upper extension 26 by means of eccentric connector 30. By use of the eccentric connector 30, padded cross members 28 can be raised or lowered with respect to horizontal member 14.

Figure 4:
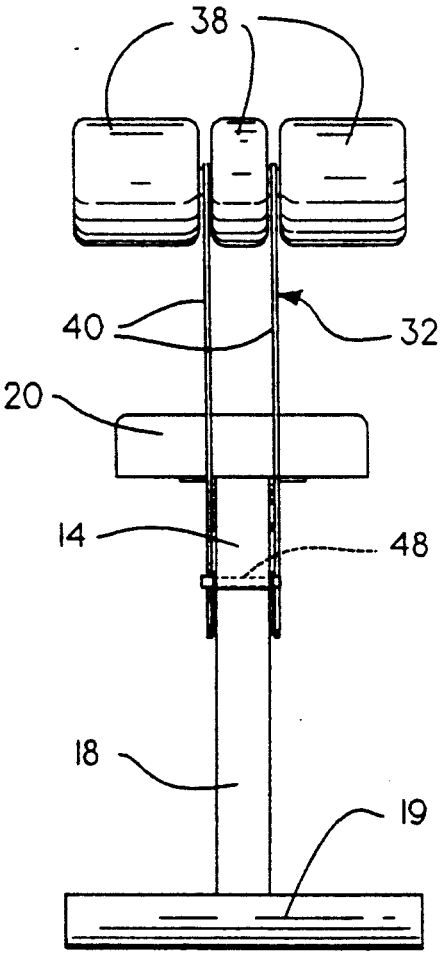
FIG. 4 is a back elevational view of the abdominal and back muscle exercising device of FIG. 1.

Pivotable barrier 32 is adjustably provided along frame 12. A pair of generally S-shaped side members 34 are mounted on horizontal member 14 and pivot around pivot pin 36. Padded cross piece 38 is provided at the upper end 40 of members 34. As best shown in FIG. 4, padded cross piece 38 is preferably formed in three sections: one section outside each of side members 34 and a third section provided between side members 34. Padded cross piece 38 is adapted to be pushed by either the chest or upper back of the human exerciser. A resilient member 42 is secured at one end to lower end 44 of member 34 and at the other end to the frame 12. Resilient member 42 is provided in such a manner that a pivoting motion of barrier 32 in a direction away from the human exerciser is opposed by resilient member 42. Resilient member 42 can be any type of elastic or spring tension member such as the variable resistance strap for exercise apparatus shown in Design Patent No. 280,244.

Figure 5:
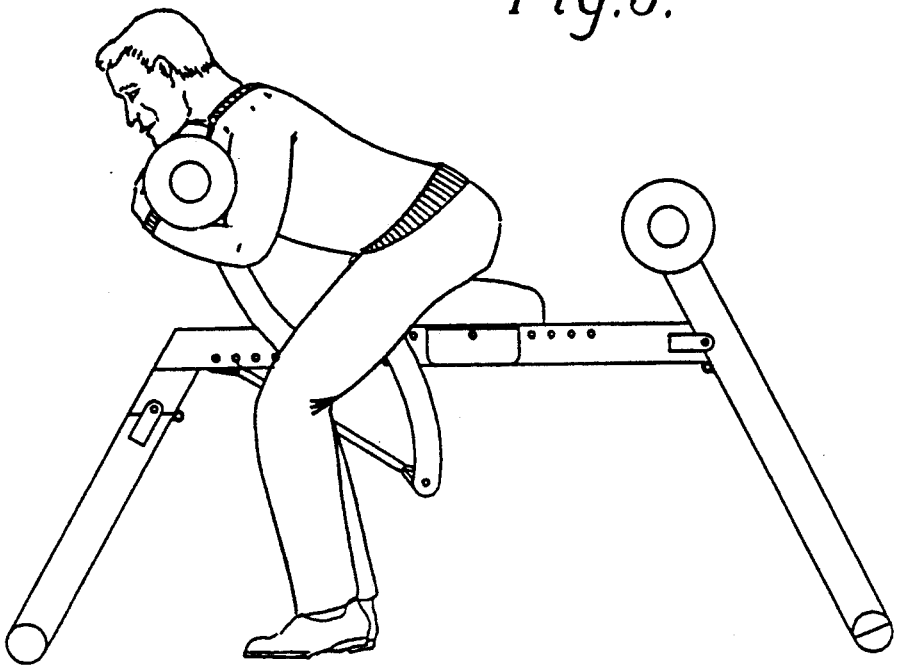
FIG. 5 is a schematic representation of the exercising device of FIG. 1 as used to exercise the abdominal muscles.

The operation of the exercise apparatus 10 will be described for both the abdominal exerciser routine and the lower back exercising routine. To exercise the abdominal muscles, the exerciser sits on seat 20 as shown in FIG. 5. The exerciser faces barrier 32 and selects an appropriate resilient member 42 or group of resilient members 42 corresponding to the desired level of tension for the exercise routine. The exerciser pushes his chest against padded cross piece 38 and pivots barrier 32 in a direction opposite seat 20. Once the exerciser has finished his forward push against the barrier 32, he releases pressure against cross piece 38 and leans back. Resilient member 42 will return barrier 32 to its normal upright position as the exerciser leans backwards. The exerciser repeats this routine until he has completed the desired set of repetitions.

Figure 6:
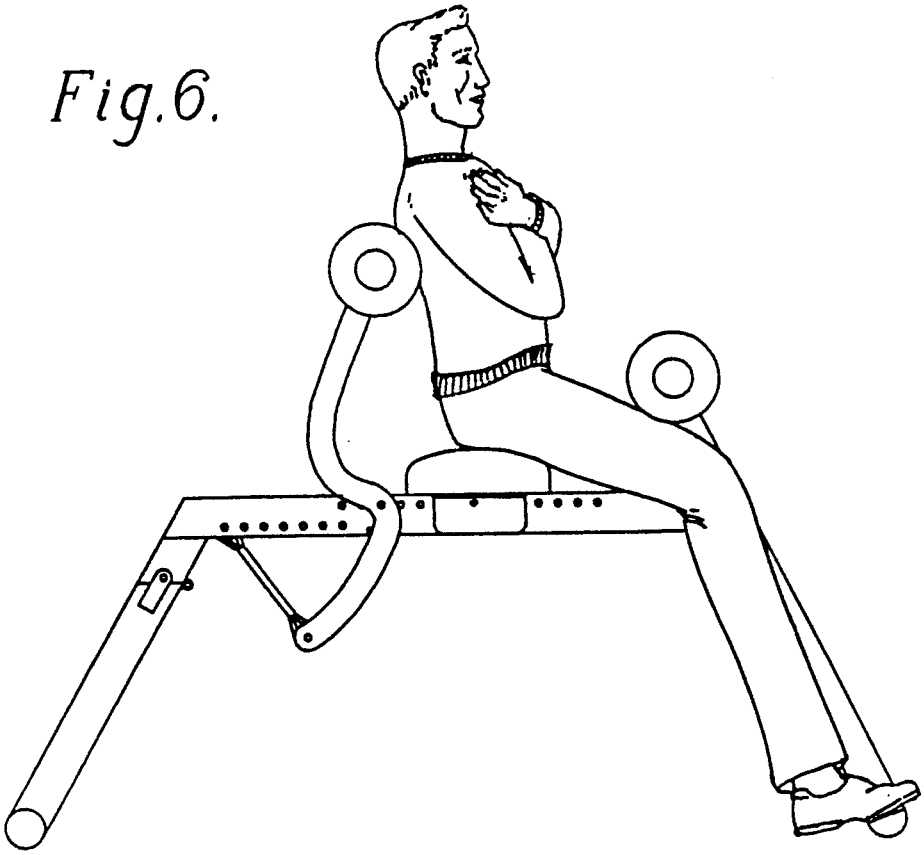
FIG. 6 is a schematic representation of the exercising device of FIG. 1 as used to exercise the lower back muscles.

The operation of apparatus 10 as a lower back muscle exerciser is shown in FIG. 6. As shown in FIG. 6, the exerciser sits on seat 20 in such a manner that his legs drape over seat 20 as he faces leg 16. The eccentric connector 30 of each padded cross member 28 is adjusted such that padded cross members 28 rest upon the knees of the exerciser. In exercising the lower back muscles, barrier 32 is provided behind the exerciser. In operation, the exerciser leans back against padded cross member 38 and pushes barrier 32 away from seat 20. Padded cross members 28 prevent the exerciser's legs from rising up during this exercise routine. The use of padded cross member 28 focuses the effort of the exerciser on the lower back muscles. Once the exerciser has completed his downward push against cross piece 38, he leans forward. Resilient member 42 forces barrier 32 back into its normal upright position. The exerciser repeats this routine as desired to complete the desired set of repetitions.

Figure 7:
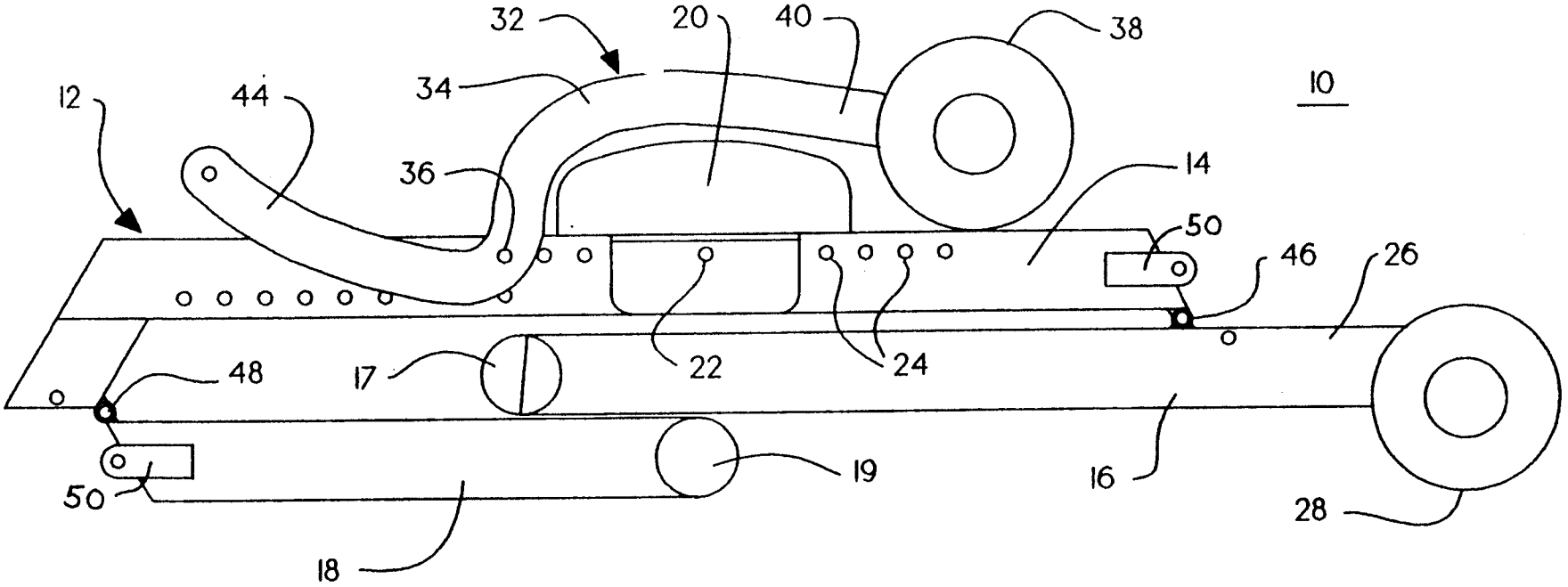
FIG. 7 is a front elevational view of the exercising device of FIG. 1 showing the legs in a collapsed configuration.

In order to accommodate home use of exercise apparatus 10, legs 16 and 18 are adapted to fold underneath horizontal member 14 as shown in FIG. 7. Hinge 46 provided on leg 16 and hinge 48 provided on leg 18 allow legs 16 and 18 to be folded in under horizontal member 14. To provide a more compact storage size, hinges 46 and 48 are provided at different locations on legs 16 and 18 so that leg 18 can be positioned immediately underneath horizontal member 14 and leg 16 can be positioned thereunder. By folding legs 16 and 18 under horizontal member 14, exercise apparatus 10 can easily be stored by laying flat against a wall. In operation, legs 16 and 18 are secured in their upright standing position by means of locking brackets 50. By providing a compact and inexpensive abdominal and lower back exercise apparatus, apparatus 10 solves a long felt need in the home exercise field.

Preferably, side members 34 of pivotable barrier 32 are generally S-shaped. This shape permits resilient member 42 to be stretched in a generally continuous and consistent manner. If side members 34 were straight instead of curved, a significant part of the pivot of the side member 34 would be accounted for by rotation of resilient member 42 about its pivots. The S-shape configuration of side members 34 reduces the rotation of resilient member 42 about its pivot and focuses the effort of the exerciser on stretching resilient member 42.

While we have described a present preferred embodiment of the invention, it is to be distinctly understood that the invention is not limited thereto but may be otherwise embodied and practiced within the scope of the following claims.

We claim:

1. An apparatus for exercising the abdominal and back muscles of a human exerciser comprising:

a. a frame, said frame including a horizontal member, said horizontal member supported on each end thereof by a pair of legs, said horizontal member provided with a plurality of spaced apart apertures, at least one of said pair of legs being provided with an extension member, said extension member including a padded cross member;

b. a seat member adapted to be supported on said horizontal member, said seat member provided with means to adjust its position along said horizontal member;

c. a pivotable lever mounted on said horizontal member, said pivotable lever provided with means to adjust its position along said horizontal member;

d. resilient means connecting said pivotable lever and said horizontal member wherein a force applied against said pivotable lever in a direction opposite said seat member is opposed by said resilient means;

e. an eccentric connecting means pivotally connecting said padded cross member to said extension for allowing said padded cross member to be eccentrically rotated about an axis thereby allowing a raising or lowering of said padded cross member against the knees of an exerciser.

2. The apparatus of claim 1 wherein said seat member is secured to said horizontal member by means of a pin, said pin passing through an aperture provided in a base of said seat member and through one of said plurality of spaced apart apertures on said horizontal member.

3. The apparatus of claim 1 wherein said pivotable lever comprises a pair of side members mounted on said horizontal member by means of a pivot pin, the upper portion of said side member being connected by a padded cross piece adapted for being pushed by the human exerciser, and a lower portion of said member being connected to said resilient means.

4. The apparatus of claim 3 wherein said pair of side members are generally serpentine.

5. The apparatus of claim 1 wherein said legs are adapted to be folded underneath said horizontal member for easy storage.

6. The apparatus of claim 5 further comprising hinge means provided on each of said pair of legs, said hinge means provided at different locations on each said pair of legs to permit a first of said pair of legs to be folded about its said hinge means underneath said horizontal member and the other of said pair of legs to be folded about its said hinge means underneath said folded first of said pair of legs.

* * * * *